US007080793B2

(12) United States Patent
Borisov et al.

(10) Patent No.: US 7,080,793 B2
(45) Date of Patent: Jul. 25, 2006

(54) APPARATUS COMPRISING AN ATOMIZER AND METHOD FOR ATOMIZATION

(75) Inventors: Yulian Y. Borisov, Moscow (RU); Nikolai A. Dubrovskiy, Moscow (RU)

(73) Assignee: Life Mist, LLC, Morrisville, PA (US)

( * ) Notice: Subject to any disclaimer, the term of this patent is extended or adjusted under 35 U.S.C. 154(b) by 199 days.

(21) Appl. No.: 10/797,550

(22) Filed: Mar. 10, 2004

(65) Prior Publication Data

US 2004/0188104 A1 Sep. 30, 2004

Related U.S. Application Data

(63) Continuation-in-part of application No. PCT/US02/32595, filed on Oct. 11, 2002.

(60) Provisional application No. 60/328,654, filed on Oct. 11, 2001.

(51) Int. Cl.

| | |
|---|---|
| ***B05B 1/08*** | (2006.01) |
| ***B05B 3/04*** | (2006.01) |
| ***B05B 1/28*** | (2006.01) |
| ***F23D 11/16*** | (2006.01) |

(52) U.S. Cl. ..... 239/102.1; 239/102.2; 239/290; 239/291; 239/418; 239/419.5

(58) Field of Classification Search ..... 239/102.1, 239/102.2, 290, 291, 294, 418, 419.5, 434, 239/426

See application file for complete search history.

(56) References Cited

U.S. PATENT DOCUMENTS

| | | | | |
|---|---|---|---|---|
| 3,667,679 | A * | 6/1972 | Wiesenberger | 239/403 |
| 4,205,786 | A | 6/1980 | Babich | |
| 4,320,696 | A * | 3/1982 | Daniels et al. | 454/323 |
| 4,408,719 | A | 10/1983 | Last | |
| 4,890,793 | A * | 1/1990 | Fuglistaller et al. | 239/427 |
| 5,495,893 | A | 3/1996 | Roberts | |
| 6,142,457 | A | 11/2000 | Holtan | |
| 6,390,203 | B1 | 5/2002 | Borisov | |

* cited by examiner

*Primary Examiner*—Davis HWU
(74) *Attorney, Agent, or Firm*—DeMont & Breyer, LLC

(57) ABSTRACT

The illustrative embodiment of the present invention is an atomizer, a method for atomization, and a system that includes an atomizer. In some embodiments, an atomizer in accordance with present invention operates at substantially higher efficiency than known atomizers. Furthermore, in some embodiments, the present atomizer is capable of operating at lower gas pressure and lower liquid pressure than most known atomizers, as is desirable for certain fire-suppression applications. Additionally, in some embodiments, the atomizer is configured with only three parts and is very easy to manufacture.

35 Claims, 10 Drawing Sheets

FIGURE 2A
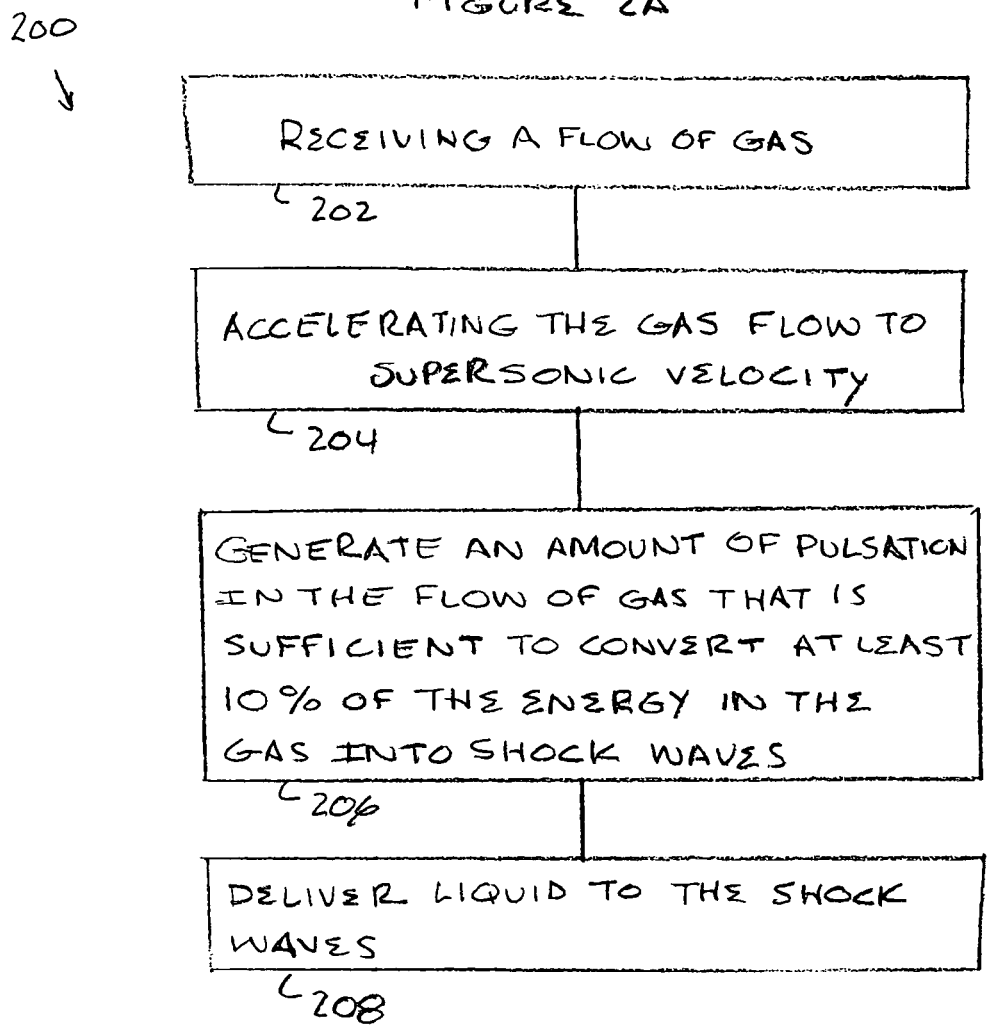
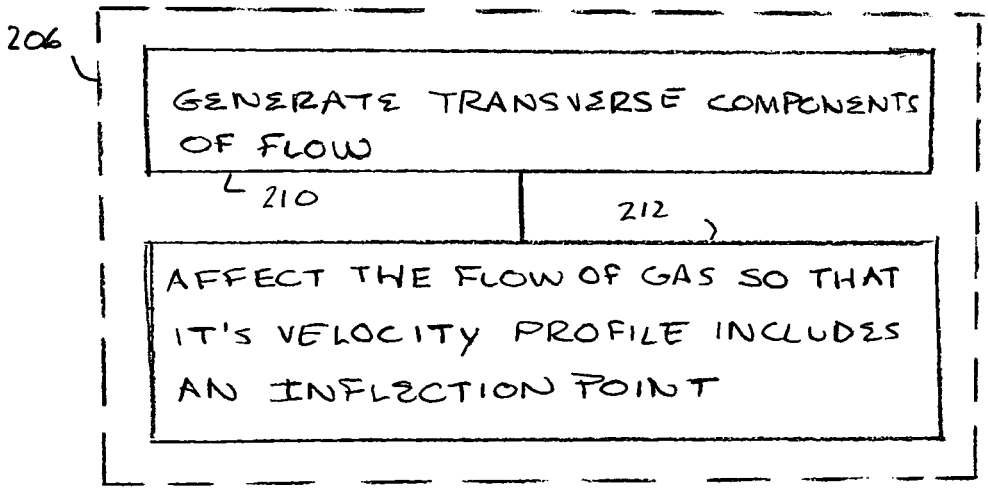
FIGURE 2B

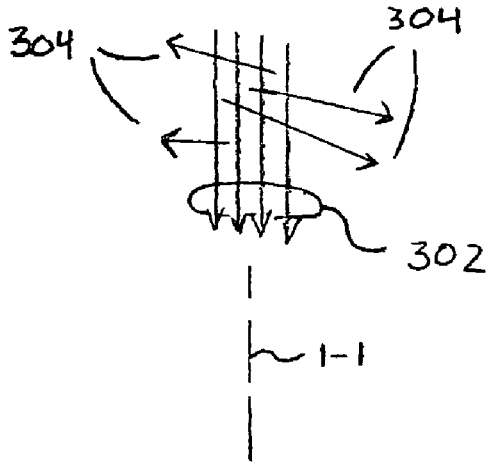
FIGURE 3A
FIGURE 3B
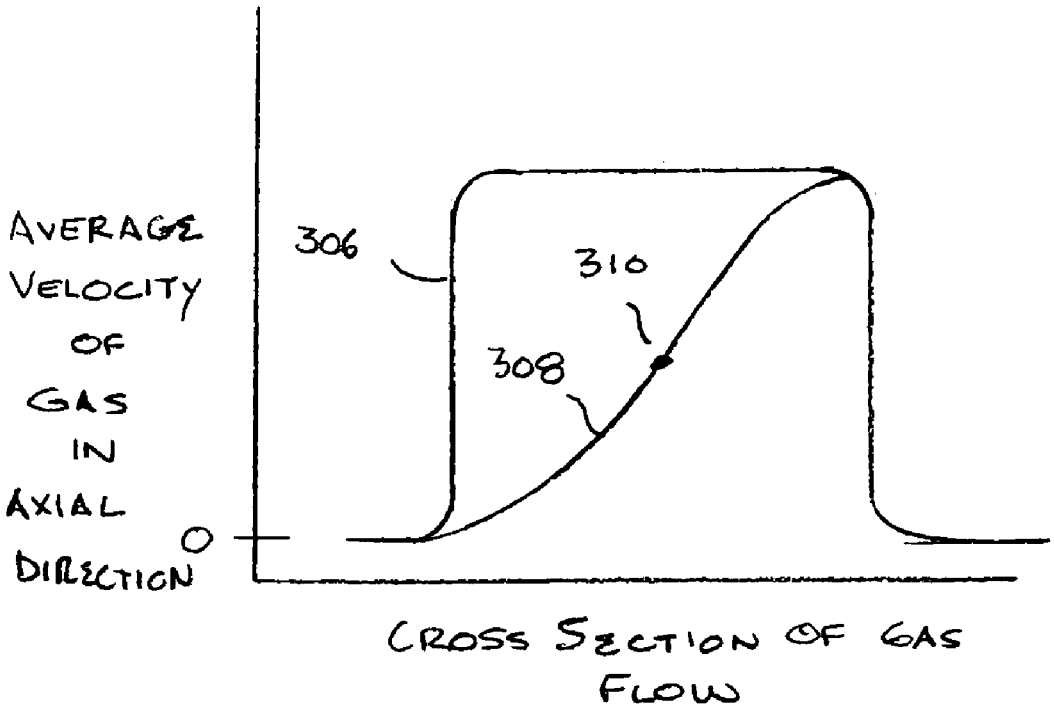

FIGURE 4A
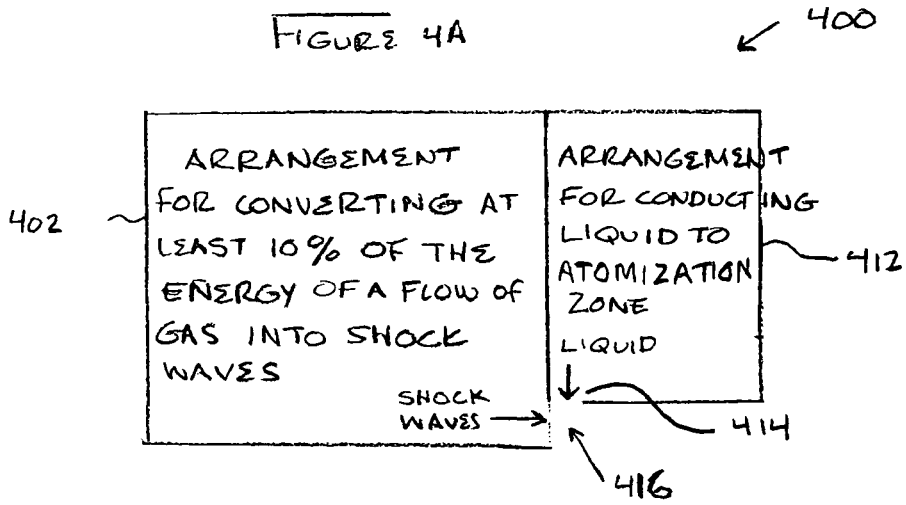
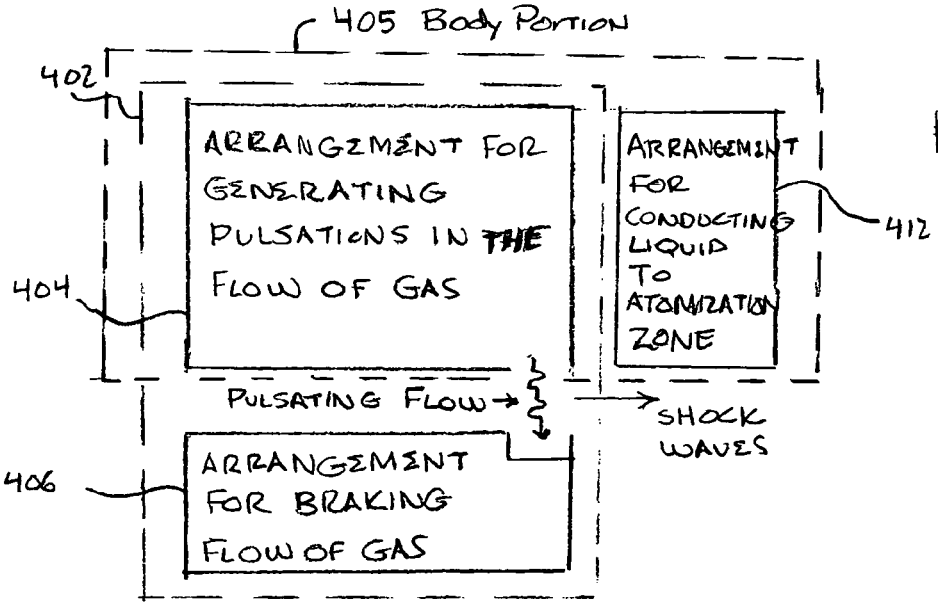
FIGURE 4B
FIGURE 4C
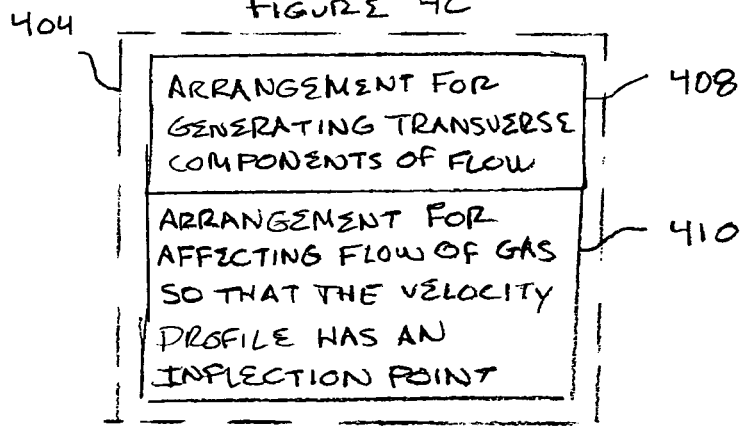

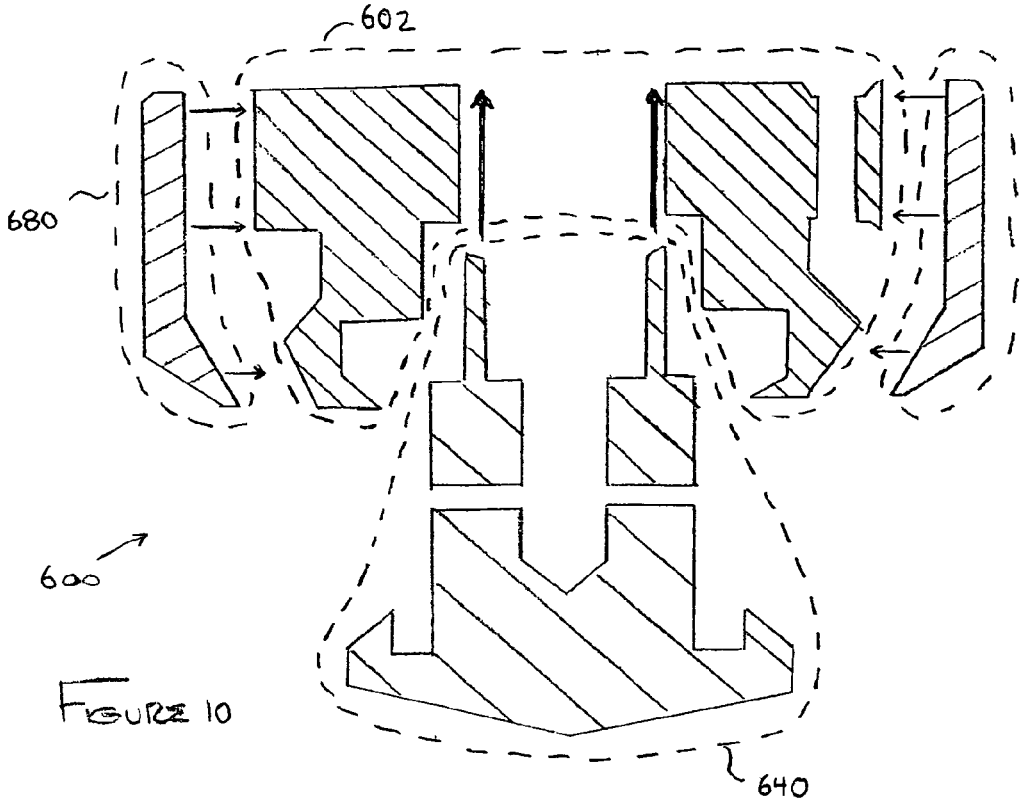
FIGURE 10
FIGURE 11
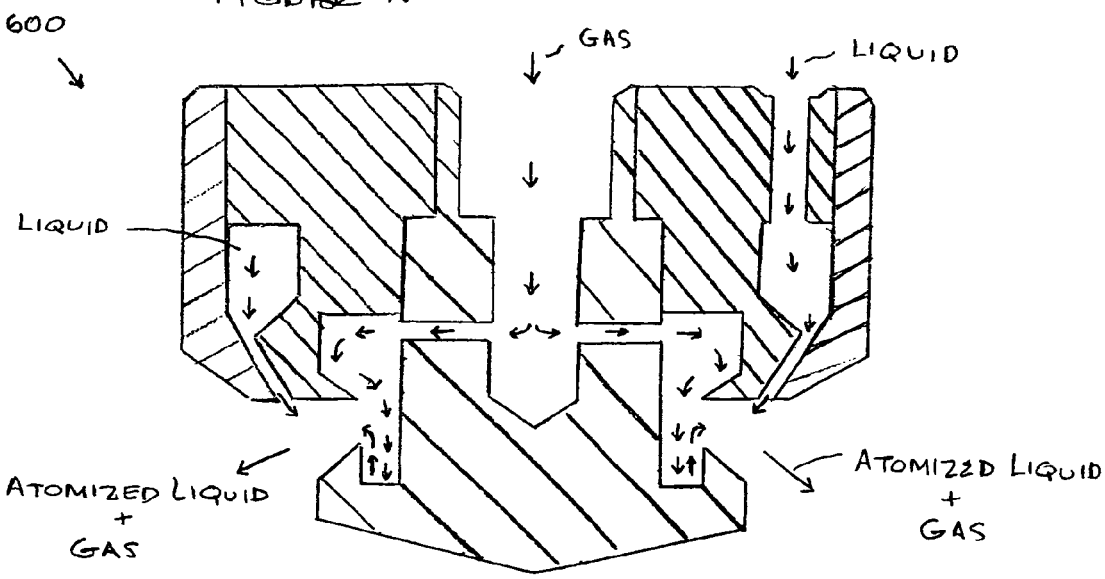

1400

APPARATUS COMPRISING AN ATOMIZER AND METHOD FOR ATOMIZATION

STATEMENT OF RELATED CASES

This application is a continuation-in-part and claims priority of PCT/US02/32595, filed Oct. 11, 2002, which claims priority of U.S. 60/328,654, filed Oct. 11, 2001, both of which cases are incorporated by reference herein.

FIELD OF THE INVENTION

The present invention relates to atomizers, methods for atomization, and systems that include atomizers.

BACKGROUND OF THE INVENTION

Atomization is a process by which a liquid is dispersed into very fine droplets. The droplets in an atomized liquid are often less than 200 microns in diameter and can be as small as about 10 microns. Atomized liquids are used in many applications including, for example, fire-suppression, fuel-combustion, coating processes, pharmaceuticals, and metallurgy, to name but a few.

Atomized liquid is generated using an atomizer. A variety of atomizer designs exist. One common type of atomizer is the "Hartman" atomizer. In a Hartman-type atomizer, a high-velocity (supersonic) gas stream impinges on a cavity resonator. The resonator abruptly brakes the supersonic gas stream, which results in the creation of shock waves. A stream of liquid exits the atomizer in the vicinity of the shock waves. The energy in the shock waves atomizes the liquid. Examples of Hartman atomizers include the atomizers disclosed in U.S. Pat. Nos. 6,390,203 and 4,408,719. The atomizer that is disclosed in U.S. Pat. No. 6,390,203, which was developed by one of the present inventors, is discussed below.

The atomizer disclosed in U.S. Pat. No. 6,390,203 is reproduced in FIG. 1 as atomizer 100. That atomizer includes rod 102, inner casing 104, outer casing 110, and head 116. Annular gas feed channel 106 is defined between rod 102 and inner casing 104. The gas feed channel leads to annular gas nozzle 108. Annular liquid feed channel 112 is defined between inner casing 104 and outer casing 110. The liquid feed channel leads to annular liquid nozzle 114. Resonator 118 is defined as an annular channel within head 116. The resonator is spaced apart from and situated in opposition to gas nozzle 108.

In operation, a subsonic flow of gas (e.g., nitrogen, etc.) is directed to gas feed channel 106. Gas is discharged from gas nozzle 108 at the speed of sound. Once discharged, the gas expands and its speed becomes supersonic. The gas is abruptly decelerated by resonator 118, which causes acoustic oscillations (i.e., shock waves) in atomization zone 120. The oscillations cause liquid (e.g., water, etc.) that is delivered to atomization zone 120 through liquid nozzle 114 to atomize. A mist of water droplets exits atomizer 100 through ring-shaped outlet 122.

In a Hartman atomizer, the amount of liquid that is atomized is proportional to the amount of shock waves produced. It is convenient, then, to express the efficiency of a Hartman atomizer in terms of the amount of shock waves that are produced by a given volume of gas (passing through the atomizer). To calculate the efficiency (according to this definition), the power, $P_{gj}$, (i.e., energy per time) of the gas jet issuing from the nozzle is calculated. This calculation is readily performed knowing the rate of gas discharge and its density. Shockwave power, $P_{sh}$, is measured in known fashion and the percentage efficiency of the atomizer is calculated by obtaining the ratio of the power in the shockwave to the power of the gas jet and then multiplying that ratio by one hundred:

$$Eff=(P_{sh}/P_{gj})\times 100 \quad [1]$$

The efficiency of standard Hartman atomizers, such those described in U.S. Pat. Nos. 6,390,203 and 4,408,719, is usually relatively low, being in a range of about five to eight percent.

The prior-art includes alternatives to Hartman-type atomizers, but these other atomizers typically exhibit even lower efficiency than Hartman atomizers. For example, U.S. Pat. No. 4,205,788 discloses a "swirl" atomizer. In this type of atomizer, a swirl chamber imparts rotary motion to a gas. The swirling gas is passed through a nozzle, which intensifies the degree of swirling and generates some acoustic oscillations, which atomize a liquid. The swirling gas contains relatively little energy and these atomizers operate at a very low efficiency of about 0.5 to about 1.0 percent.

In another type of atomizer, liquid is atomized via a substantially stationary decrease in compression. In this type of atomizer, as exemplified by U.S. Pat. No. 5,495,893, bubbles of pressurized gas are dispersed in a liquid. The gas-liquid mixture is then exposed to a substantially instantaneous reduction in pressure (such as is caused by a sudden, large increase in flow area). (See also, U.S. Pat. No. 6,142,457.) The reduction in pressure causes the gas bubbles to rapidly expand and atomize the liquid. The mixture is then accelerated to supersonic velocity through a nozzle. As the mixture decelerates to sonic velocity, shock waves are produced, which further decrease the size of the droplets in the atomized liquid.

The efficiency of "stationary-decrease-in-compression" atomizers is typically within a range of about 2 to 3 percent. The reason for the low efficiency is that these atomizers produce relatively few shock waves per unit time, since oscillation does not occur as in a Hartman atomizer.

In circumstances in which an unlimited amount of gas and liquid is available for use in an atomizer, the benefits of a higher-efficiency atomizer are not immediately clear. But in circumstances in which gas and liquid availability is severely limited, the benefits of increased efficiency are manifest. An example of an application in which these resources are strictly limited—and in which atomizer efficiency is therefore very important—is fire-suppression in aircraft.

Many existing fire-suppression systems for aircraft use a fluorine-containing material (e.g., Halon®). This material has been associated with the depletion of the ozone layer and has been banned by the international community for general use. Aircraft are, however, exempt from this ban and are allowed to continue to use Halon®-based fire-suppression systems until a viable alternative is developed. One potential alternative to Halon®-based systems is a system that uses an atomizer to generate a water mist. The water mist, along with a quantity of nitrogen gas that atomizes water to create the mist, is discharged to suppress a fire. (See, e.g., U.S. Pat. No. 6,390,203.) There are strict weight allowances on aircraft, and nitrogen and water are not exempt from them. As a consequence, it is critically important that a nitrogen/water mist fire-suppression system includes a relatively more-efficient atomizer, which will use less nitrogen (thereby saving weight) to provide a given quantity of water mist than a relatively less-efficient atomizer.

Notwithstanding the foregoing, there has been little progress made toward improving the efficiency of atomizers. It might be supposed that since atomizers have such a relatively uncomplicated structure, little can be done to improve their efficiency. Or, in view the relatively sophisticated understanding of the fluid dynamics of gas flow and the production of shock waves that prevails in the art, it might be supposed that all that can be done to improve atomizers has been done. These suppositions would, however, be incorrect.

While simple in outward appearance, an atomizer, such as a Hartman atomizer, is extraordinarily complex in terms of the fluid dynamic and acoustic behaviors that govern its operation. And to the extent that these behaviors are understood, the prior art has demonstrated little ability to apply this understanding to the development of higher-efficiency atomizers. But it is one thing to understand the theories, it is quite another to apply them to develop a specific atomizer configuration that exhibits improved efficiency. A better explanation for any lack of progress toward the development of higher-efficiency atomizers is simply the complexity of the problem. Notwithstanding sophisticated modeling techniques, this problem is so complex that improvements are at least as likely to come from empirical studies and observation as from theoretical consideration of the problem.

SUMMARY

The illustrative embodiment of the present invention is an atomizer, a method for atomization, and a system that includes an atomizer.

In some embodiments, an atomizer in accordance with present invention operates at substantially higher efficiency than most known atomizers, and in particular most Hartman-type atomizers. For example, while typical prior-art Hartman atomizers operate at about 5 to 8 percent efficiency, embodiments of the present atomizer operate at efficiencies of at least 10 percent, preferably at least 15 percent, more preferably at least 20 percent, and most preferably at an efficiency of 25 percent or more.

A reason for this higher efficiency is the significantly greater instability that develops within the supersonic gas flow of the atomizers described herein. This greater instability is evidenced by a substantially greater amount of pulsation in the gas flow. (The words "pulsation" and "pulsations" are used interchangeably in this specification.) The "amount" (e.g., frequency, intensity) of these pulsations determines the efficiency at which energy in the gas flow is converted to acoustic oscillations (i.e., shock waves). That is, to the extent that there is a greater amount of pulsation in the flow of gas, more of the energy in the gas will be converted to shock waves. In other words, more pulsations mean higher efficiency. The reasons why greater instability is developed in the gas flow of the atomizers disclosed herein are given below.

Furthermore, in some embodiments, atomizers in accordance with the illustrative embodiment operate at lower gas pressure and lower liquid pressure than most atomizers. Low-pressure operation is particularly desirable for certain fire-suppression applications. A further benefit of an atomizer in accordance with the illustrative embodiment is its structural simplicity. In particular, in some embodiments, the atomizer comprises only three parts. This reduces manufacturing costs, improves reliability and decreases the coefficient of variation in atomizer performance.

An illustrative method for atomization comprises:

receiving a flow of gas;

accelerating the flow of gas to supersonic velocity;

generating an amount of pulsation in the flow of gas that is sufficient to enable the conversion of at least ten percent of the energy of the flow into shock waves; and delivering liquid to the shock waves at an atomization zone.

Notwithstanding the implied order of the operations of the method, as listed above, at least some of the operations or sub-operations that are responsible for generating the pulsations in the flow of gas occur prior to accelerating the flow of gas to supersonic velocity.

The method requires the creation of a "sufficient" amount of "pulsation" in the supersonic flow of gas. Both the amplitude and frequency of the pulsation contribute to satisfying the requirement of a "sufficient" amount. The pulsation of the gas is created by destabilizing the flow of gas within the atomizer. In accordance with the illustrative embodiment, one or more operations are employed or conditions are created to destabilize the gas flow or otherwise promote pulsation, including, without limitation:

generating a sufficient amount of transverse components of speed in the gas;

affecting the flow of gas so that its velocity profile is characterized by an inflection point; and operating at a gas pressure that is within the range of about 21 psig to about 52 psig.

As used herein, the phrase "transverse component(s) of speed" is used to describe a particle of gas that has a non-axial vector of motion, wherein the axial direction is defined to be the direction in which the bulk of the gas flows at given location within the atomizer. A non-axial vector is described by two components, a "transverse" component, which is orthogonal (i.e., 90 degrees) to the axial direction and an "axial" component that is aligned (i.e., 0 degrees) with the axial direction. The particle's net vector is determined, of course, by the relative magnitudes of the two components of speed. In other words, any particle of gas that is moving in a non-axial direction has a transverse component of speed.

In the present context, a "sufficient" amount of transverse components of speed is an amount that results in an inflection point in the cross section of the velocity profile. (These two conditions, then, are not independent of one another.) The amount of transverse components and the direction of those components contribute to the establishment of the desired velocity profile (i.e., the presence of an inflection point). As is known by those skilled in the art of fluid dynamics, for inviscid (i.e., no viscosity-purely mechanical) flow, the velocity profile must contain an inflection point somewhere in its cross section to be instable.

With regard to operating pressure, it has been found that it is particularly advantageous to perform the atomization at a gas pressure within the atomizer that is within a range from about 21 psig to about 52 psig. Gas pressures falling within this range have been found to be unusually effective for the efficient creation of shock waves. To account for pressure drop, gas inlet pressure to the atomizer should be at least about 25 psig, since a critical pressure of 21 psig directly upstream of an internal gas nozzle is required for developing sonic flow, apart from any efficiency considerations. In some embodiments, the gas inlet pressure is advantageously limited to about 55 psig (to provide a maximum pressure of about 52 psig within the atomizer).

Although the exact mechanism is somewhat uncertain, it is believed that within this range of pressure, a second resonance—a pressure-based resonance that appears to be unrelated to the resonance frequency of the resonator—is created. This additional "resonance" is responsible for more instability and more pulsation. As previously indicated, the pulsation of the gas determines the efficiency by which the energy in the supersonic gas flow is converted in acoustic oscillations or shock waves. To the extent that there is more pulsation (frequency or amplitude) in the gas flow, the intensity of the resulting shock waves increases. And if the intensity of the resulting shock waves increases, more liquid is atomized or the liquid is atomized into smaller droplets.

The destabilizing operations or conditions listed above are promoted by providing an atomizer that, by virtue of its configuration, etc., exhibits one or more of the following attributes:

- a compression factor, μ, that is within a range of about 5 to 50 and, and in some embodiments, is in a range of about 5 to about 30;
- a conicity angle, α, that is in a range of about 50 to about 80 degrees, among any others. In the illustrative embodiment, these attributes are defined with respect to certain structures within the atomizer; namely, a gas cavity and a gas nozzle. These structures are described briefly below and more fully later in the Detailed Description section of this specification.

Briefly, the compression factor, μ, is a ratio of the cross-sectional area for flow at the inlet of the gas nozzle and the cross-sectional area for flow at the outlet of the gas nozzle:

$$\mu = A_F^I / A_F^O \quad [2]$$

The conicity angle, α, refers to the angle by which the nozzle tapers from its inlet to its outlet.

In the illustrative embodiment, the gas cavity is disposed immediately upstream of the gas nozzle. In some embodiments, the (axial) direction of the opening that leads into the gas cavity is substantially orthogonal to the (axial) direction of the exit from the gas cavity (and entrance to the gas nozzle). As a consequence, the direction of the bulk flow of gas into the gas cavity and the direction of the bulk flow of gas out of the gas cavity are different from one other. This contributes to the generation of transverse components of speed. Furthermore, the gas cavity and gas nozzle or both, as appropriate, are dimensioned to provide a compression factor that is within the desired range (i.e. 5–50) and the gas nozzle is shaped to provide a conicity angle that is within the desired range (i.e., 50–80 degrees).

As long as the flow of gas is at or above a critical pressure of about 21 psig in the gas cavity, the flow of gas reaches sonic velocity at the exit of the nozzle and reaches supersonic velocity as the flow expands beyond the nozzle. As the gas exits the nozzle, a flow pattern that exhibits a sufficient amount of transverse components of speed and a velocity profile that exhibits an inflection point are established. Pulsation or unstable gas flow results.

This supersonic, unstable gas flow is directed toward a cavity resonator that is spaced apart from and opposes the gas nozzle. In some embodiments, the gas flow pulses at a rate of at least about 18 kHz—18,000 times per second—in accordance with the resonance frequency of the cavity resonator. As the unstable, supersonic gas slams into the resonator, shock waves are generated. The shock waves propagate toward an atomization zone.

Liquid, which is delivered to the atomization zone, is atomized into droplets by the shock waves. The size of the ensuing liquid droplets is a function of the frequency of the shock waves, the sound pressure resulting from the shock waves, the gas density and the liquid surface tension. Beyond these dependencies, droplet size can be adjusted up or down by simply increasing or decreasing the rate of flow of the liquid through the atomizer.

Again, a key reason why an atomizer in accordance with the illustrative embodiment operates at higher efficiency than those in the prior art is that:

- it generates substantially more pulsation than prior-art Hartman atomizers. This is because atomizers in accordance with the illustrative embodiment are configured with instability-enhancing features not generally found in the prior art. As previously described, these features include, without limitation, the aforementioned gas cavity with directionally-skewed in-flow and out-flow, an appropriate value for a compression factor, and a suitable conicity angle of the gas nozzle, as defined above.

Furthermore, in some embodiments, in addition to the use of one or more of these instability-enhancing features, the atomizer is operated within a specific range of pressure (about 21 to 52 psig) that has been found to further increase atomization efficiency.

The present atomizers are suitable for use in a variety of applications. One such application is in a low-pressure, fire-suppression system. A low-pressure system is generally lighter, safer, and less expensive to construct, install and maintain than a high-pressure system. Consider, for example, an application in which a fire-suppression system is used in the cargo hold of an aircraft. Motions of the aircraft (e.g., during take-off, landing, and turbulence, etc.) can impart stresses to the various piping connections within a fire-suppression system. These stresses can result in breaches of the piping connections. Breaches in a high-pressure line, such as will be found in a high-pressure fire-suppression system, can cause catastrophic damage on an aircraft. Breaches in a low-pressure line are of far less concern.

For fire-suppression applications, the gas used in the atomizer is typically nitrogen and the liquid is typically water. The system includes ample supplies of water and nitrogen (e.g., from bottles, from a nitrogen generator, etc.), piping to connect the water and nitrogen supplies to the atomizers, detectors for detecting a fire condition, and actuating capabilities to start a flow of nitrogen and water when a fire condition is detected.

Further details concerning atomizers, atomization methods, and a system incorporating an atomizer in accordance with the present invention is provided in the following Detailed Description and the appended Drawings.

BRIEF DESCRIPTION OF THE DRAWINGS

FIG. 2A depicts method 200 in accordance with the illustrative embodiment of the present invention.

FIG. 2B depicts sub-operations of one of the operations of method 200.

FIG. 3A depicts an illustration of transverse components of speed within a flow of gas.

FIG. 3B depicts a cross section of a velocity profile of the flow of gas, wherein the profile has an inflection point.

FIG. 4A depicts a block diagram of atomizer 400 in accordance with the illustrative embodiment of the present invention.

FIG. 4B depicts a block diagram that shows illustrative sub-elements 404 and 406 of element 402 of atomizer 400.

FIG. 4C depicts a block diagram that shows illustrative sub-elements 408 and 410 of sub-elements 404 of atomizer 400.

FIG. 10 depicts the three pieces that compose atomizer 600.

FIG. 11 depicts flow of liquid and gas through atomizer 600.

DETAILED DESCRIPTION

I. Overview

Figure 1:
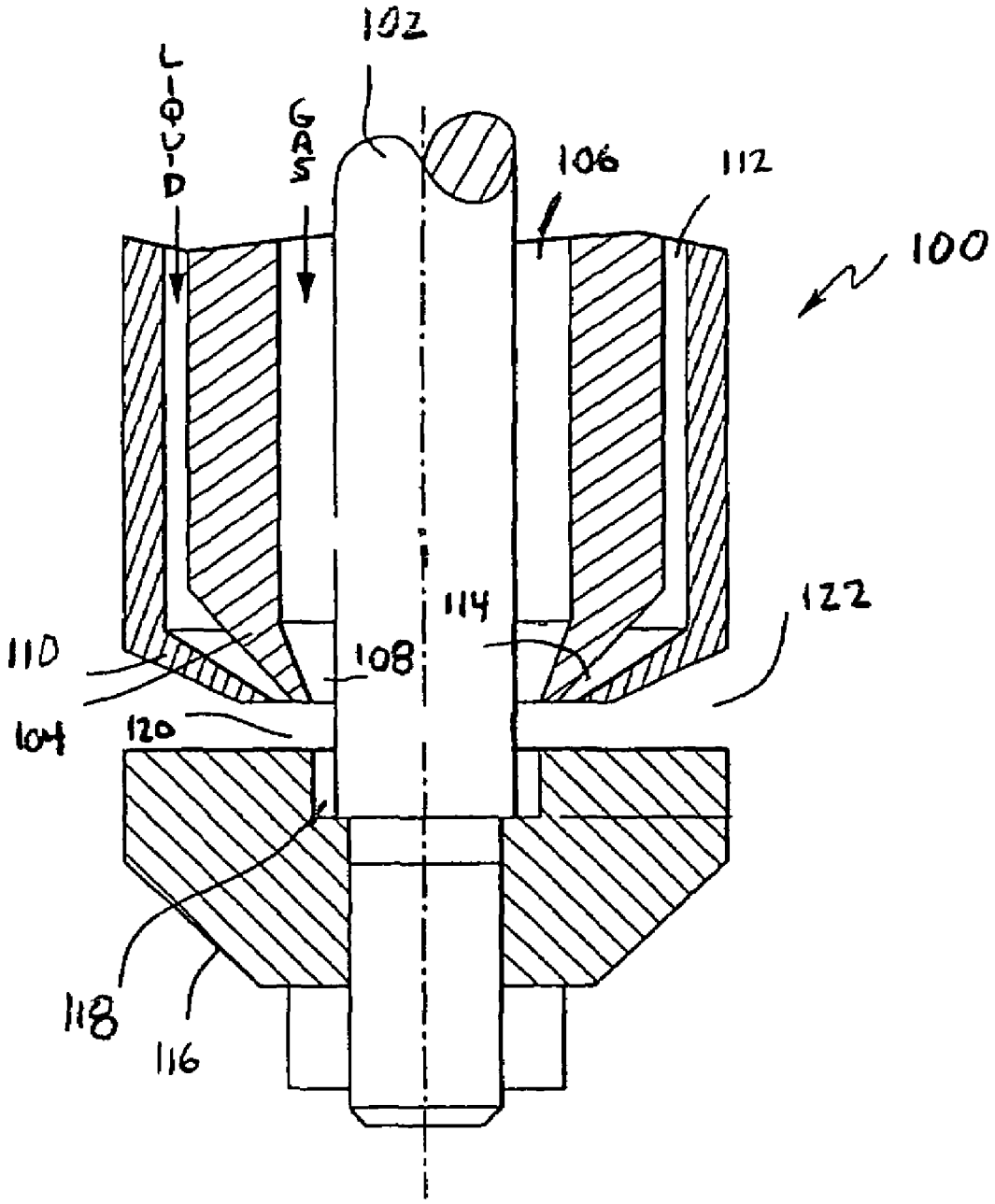
FIGURE 1 PRIOR ART
FIG. 1 depicts prior-art Hartman atomizer 100.

The illustrative embodiment of the present invention is an atomizer, a method for atomizing, and a system that incorporates an atomizer. The atomizer is useful in a variety of industrial applications, including fire suppression systems, fuel-combustion processes, coating processes, to name a few. The atomizer operates with two fluids: a gas and a liquid. Fluid selection is application dependent, although the liquid is typically water, which is cheap, readily available, non-toxic and environmentally friendly. The water or other liquid used in the present atomizers can include additives for any of a number of purposes. A partial listing of water-based solutions suitable for use with the present atomizer includes: water solutions of insecticides, herbicides, bactericides, fertilizers, medications, as well as melted metals (for the production of fine metal powder). The gas is usually nitrogen, for at least some of the same reasons (relatively safe, readily availability, etc.) that water is used as the liquid. Other suitable gases include, without limitation, carbon dioxide, argon and mixtures thereof.

Although simple in structure, the theory underlying the operation of atomizers such as those described herein is quite complex. A thorough understanding of the atomizer's operation involves an awareness of fluid dynamic and acoustic behaviors that are beyond the scope of this specification. Most importantly, such theory is not particularly germane to an understanding of the present invention and would tend to distract rather than enlighten. Those skilled in the art will be aware of the relevant theoretical considerations, which, in conjunction with the disclosure provided herein and in the appended drawings, will enable them to make and use the illustrative embodiments and other variations that are consistent therewith. To the extent that some theoretical details are believed to be useful for pedagogical purposes, they will be provided.

As previously discussed, atomizers that are described in this specification function by generating shock waves that atomize a liquid. The shock waves are generated by creating instability in a supersonic flow of gas and then abruptly braking the gas flow, such as with a cavity resonator. In some embodiments, atomizers described herein operate at substantially higher efficiencies than those in the prior art. The reason for this is that the present atomizers incorporate a variety of instability-inducing features that are capable of destabilizing the gas to a far greater extent than atomizers in the prior art. Furthermore, in some embodiments, the present atomizers are operated within a particular range of pressure that has been found to promote the creation of shock waves.

II. Method in Accordance with the Illustrative Embodiment

FIG. 2A depicts method 200 in accordance with the illustrative embodiment of the present invention. Method 200 includes the operations of:

receiving a flow of gas (operation 202);

accelerating the flow of gas to supersonic velocity (operation 204);

generating an amount of pulsation in the supersonic flow that is sufficient to enable conversion of at least ten percent of the energy in the flow into shock waves (operation 206); and delivering liquid to an atomization zone (operation 208).

Operation 202 typically involves receiving a subsonic flow of gas. In accordance with operation 204, the flow of gas is accelerated to supersonic velocity. This typically involves a change in cross-sectional flow area or a change in pressure or both.

In accordance with operation 206, pulsations are generated in the now supersonic flow of gas. More particularly, an amount (frequency and/or intensity) of pulsation is generated that is sufficient to enable the conversion of at least ten percent of the energy in the supersonic gas flow to shock waves.

Shock waves are produced by abruptly braking the pulsating, supersonic flow of gas, as is described in more detail later in this specification. Liquid is delivered to an atomization zone where it is atomized by the power of the shock waves.

FIG. 2B depicts sub-operations 210 and 212 of operation 206. These sub-operations are responsible for generating a suitable amount of pulsation in the supersonic flow of gas.

Operation 210 requires generating transverse components of speed within the flow of gas. These "transverse components," which generally appear after the gas is accelerated to supersonic velocity, flow in directions other than the direction of the bulk flow of gas. This is illustrated in FIG. 3A, which depicts flow of gas 302. The direction of the bulk flow is along axis 1—1, which is referred to herein as the "axial" direction. Transverse components of speed 304 are depicted within bulk flow 302 as components that flow in directions other than along axis 1—1. The transverse components of speed ultimately create shear flow. The presence of shear flow is a necessary condition to create the instability that leads to pulsation in the flow of gas. While most atomization methods will create some amount of transverse components of speed, they generally create far less than the atomization methods and the atomizers that are described herein. And this is a reason for the relatively low efficiency of prior art atomization methods and atomizers.

Operation 212 requires affecting the flow of gas such that the velocity profile of the gas includes an inflection point. It is well known (Rayleigh, 1880) that in a shear flow, a necessary condition for instability is that there must be a point of inflection somewhere in the velocity profile U(z):

$$d^2U/dz_2=0 \quad (3)$$

This is simply a consequence of the conservation of momentum. FIG. 3B depicts two plots 306 and 308 showing average gas velocity in the axial direction across a cross section of a gas flow. Velocity profile 306 is flat and, therefore, is stable. On the other hand, velocity profile 308 includes inflection point 310, which is required for unstable flow.

Sub-operations 210 and 212 provide at least two interrelated conditions that are necessary to generate the pulsations required in operation 206.

The term "sufficient" is used in operation 206 and impliedly arises in the consideration of operation 210. In other words, most atomization methods generate transverse components of speed, which lead to pulsations in the flow of gas. The distinction between those prior-art methods, and the present method, at least at the level of specificity of operations 206, 210, and 212, is that most prior-art methods are not capable of generating sufficient transverse components of speed to establish a velocity profile that includes an inflection point. As a consequence, they are not capable of generating sufficient pulsations to achieve an efficiency of ten percent or more, as required for the illustrative method.

Since both the amount of transverse components of speed, and the direction of those components contribute to establishing an inflection point in the velocity profile, it is impractical to define the modifier "sufficient" in terms of an "amount" of these quantities. Rather, the term "sufficient" is defined with reference to a result, i.e., the amount/direction of the transverse components of speed are sufficient when an inflection point is established in the velocity profile. Furthermore, "sufficient" is also defined with respect to certain structural criteria of a device that carries out the atomization method.

Two structural (or structural-related) criteria of particular importance relate to conditions at a gas nozzle, which is typically found in devices that carry-out atomization methods. The gas nozzle is typically used to accelerate the flow of gas (as per operation 204), among other purposes. The aforementioned criteria involve (1) the degree to which the gas flow is compressed as it passes through the nozzle and (2) pertain to the shape of the nozzle. The first criterion, which is the compression factor, μ, should be in a range of between about 5 to about 50, and is advantageously within a range of about 5 to about 30. The second criterion, which is the "conicity angle, α," is advantageously within a range of 50 to 80 degrees. Further details regarding these criteria are provided later in this specification in conjunction with a description of an atomizer in accordance with the illustrative invention.

III. Apparatus in Accordance with the Illustrative Embodiment

FIG. 4A depicts, via a block diagram, atomizer 400. Atomizer 400 includes arrangement 402 for converting at least ten percent of the energy of a supersonic flow of gas into shock waves and arrangement 412 for conducting liquid to the atomization zone. Arrangement 412 delivers liquid via liquid outlet 414 to atomization zone 416. Shock waves generated from arrangement 402 propagate to atomization zone 416 and atomize the liquid in known fashion.

FIG. 4B depicts further detail of an embodiment of arrangement 402. Arrangement 402 comprises arrangement 404 for generating pulsation in the flow of gas and arrangement 406 for abruptly braking the flow of gas. In the illustrative embodiment, arrangement 404 for generating pulsation and arrangement 412 for conducting liquid are contained in body portion 405 of atomizer 400. As in operation 206 of method 200, arrangement 404 for generating pulsation must generate sufficient pulsations to enable the conversion of at least ten percent of the energy of a supersonic gas flow into shock waves. As the pulsating, supersonic flow of gas is abruptly braked by arrangement 406, shock waves are produced. The shock waves propagate toward atomization zone 416 to which liquid is delivered.

FIG. 4C depicts further detail of an embodiment of arrangement 404 for generating pulsations. In the embodiment depicted in FIG. 4C, arrangement 404 includes arrangement 408 for generating transverse components of speed and arrangement 410 for affecting the flow of gas so that the velocity profile has an inflection point. The concept of "transverse components of speed" and the "inflection point" have previously been described in conjunction with method 200.

Figure 5A:
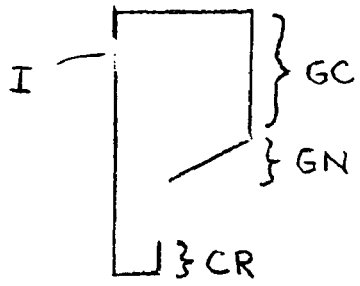
FIGS. 5A–5C depicts an illustrative implementation of sub-elements of FIG. 4B, wherein the elements are implemented as a gas cavity, gas nozzle and cavity resonator.

FIG. 5A depicts a group of structures that are collectively able to function as an implementation of arrangement 402 (for promoting the conversion of at least ten percent of the energy of an at least sonic flow of gas into shock waves). These structures include gas cavity GC, gas nozzle GN, and cavity resonator CR. Similarly, gas cavity GC and gas nozzle GN are collectively able to function as an implementation of arrangements 404 (for generating pulsation), arrangement 408 (for generating transverse components of speed), and arrangement 410 (for generating a velocity profile with an inflection point).

To be suitable as an implementation of arrangement 402, however, wherein at least ten percent of the energy must be converted to shock waves, the structures must satisfy certain provisos. For example, in some embodiments, gas nozzle GN must be appropriately dimensioned and configured to provide:

- a compression factor, μ, that is within a range of between about 5 and about 50, and advantageously within a range of 5 to 30; and
- a conicity angle, α, with a range of 50 to 80 degrees.

Figure 5C:
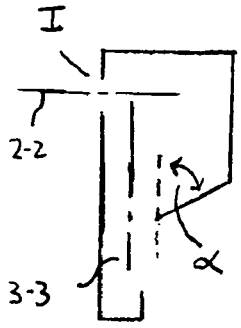
Figure 5B:
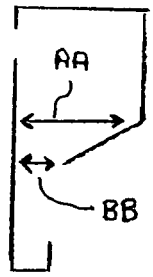

With reference to FIG. 5B, for gas nozzle GN, compression factor, μ, is given by the ratio of the cross-sectional area for flow at the mouth of the gas nozzle to the cross-sectional area for flow at the outlet of the nozzle. For other nozzle configurations, the compression factor might be expressed somewhat differently. In conjunction with the disclosure provided herein, those skilled in the art will be able to modify the definition of compression factor, as appropriate, to account for changes in the configuration of the atomizer.

Conicity angle α is defined in FIG. 5C. For gas nozzle GN, conicity angle α is a measure of the inward taper of the nozzle. It is notable that axis 2—2 of inlet I and axis 3—3 through outlet of gas cavity GC are orthogonal to one another. As a consequence, the direction of the bulk flow of gas G into cavity GC and the direction of the bulk flow of gas G out of gas nozzle GN are substantially different. This difference in direction, in conjunction with appropriate selection of compression factor p and conicity factor α, as detailed above, provide a complete description of an embodiment suitable for promoting the conversion of at least ten percent of the energy of a supersonic flow of gas into shock waves because it is capable of generating the requisite instability (pulsation). This embodiment is capable of generating the requisite instability because it is capable of generating a sufficient amount of transverse components of speed to establish a velocity profile that has an inflection point. It is also understood that there are certain requirements for resonator CR as well, but these are controlled by standard design considerations that are described later in this specification.

In some other embodiments, in addition to providing the requisite characteristics of gas cavity GC and gas nozzle GN, the pressure of the gas (at the inlet to the atomizer) is in a range of about 25 to 55 psig. As previously indicated, operating within this range of pressure further increases the efficiency of an atomizer in accordance with the illustrative embodiment of the present invention.

Figure 5D:
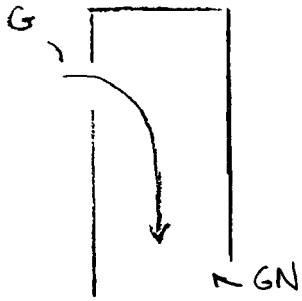
FIGS. 5D–5F depicts various flow configurations for the implementation of FIGS. 5A–5C, as a function of conicity angle of the gas nozzle.
Figure 5E:
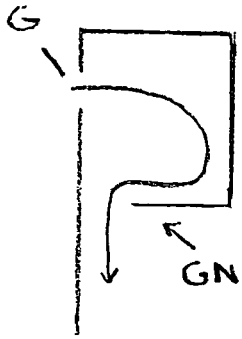
Figure 5F:
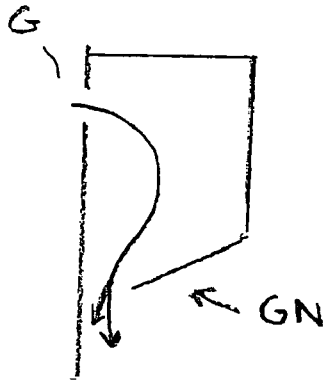

FIGS. 5D through 5E provide a generalized depiction of the impact of conicity angle on a flow of gas G through gas cavity GC and gas nozzle GN. Specifically, FIG. 5D depicts gas nozzle GN with a conicity angle $\alpha=0$ degrees. Gas G flows with little deviation through gas nozzle GN and does not develop the requisite instability (i.e., too few transverse components of speed are generated). FIG. 5E depicts gas nozzle GN with a conicity angle $\alpha=90$ degrees. This provides too much braking such that the gas flow is not at sonic or greater velocity as it leaves the gas nozzle GN. As a consequence, the flow is incapable of creating shock waves. On the other hand, FIG. 5F depicts gas nozzle GN with a conicity angle that is within the range of 50 to 80 degrees. In this case, gas flow G is sufficiently deviated to generate the required shear components downstream of gas nozzle GN and to establish the desired velocity profile.

It will be understood that while FIGS. 5A–5C depict gas nozzle GN having a straight or linear taper, in some other embodiments, the gas nozzle has a different taper. For example, in some embodiments, the gas nozzle is parabolic, has an irregular surface, etc. These variations might affect the acceptable range for the conicity angle. Those skilled in the art will be able to determine any such change in the desired range by, for example, changing conicity angle in an exemplary atomizer and observing the affect on the velocity profile (e.g., the velocity profile should satisfy the inflection point criterion). As a consequence, any such deviation in conicity angle from the specified range of 50 to 80 degrees, as a result of modifications to the structure of gas nozzle GN, falls within the anticipated scope of the appended claims.

Figure 13:
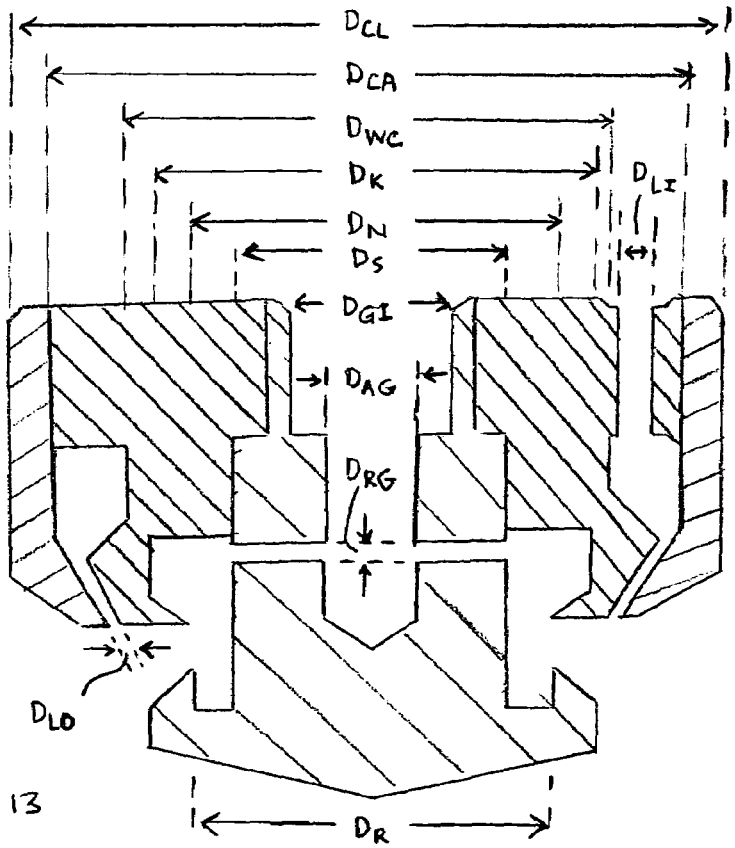
FIG. 13 depicts some dimensions of atomizer 600.
Figure 14:
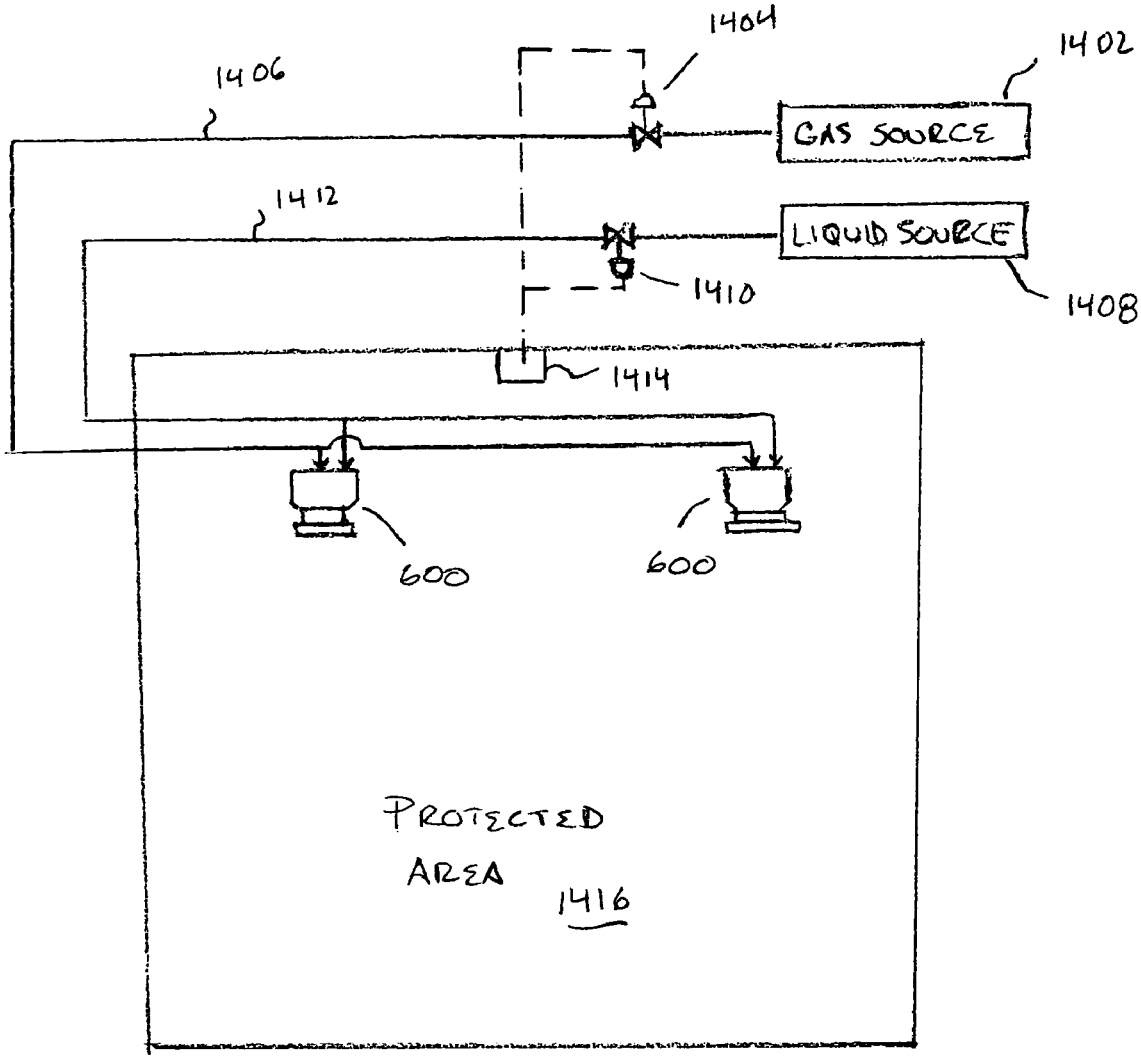
FIG. 14 depicts a system for fire suppression that incorporates one or more of the present atomizers.

IV. Specific Implementation of an Atomizer in Accordance with the Illustrative Embodiment The remainder of this Detailed Description pertains to atomizer 500, which is a specific implementation of the illustrative embodiment (i.e., atomizer 400). The structure of atomizer 600 is described in Section IV.A, in Conjunction with FIGS. 6A–6B, 7–9 and 10. In Section IV.B, and in conjunction with FIG. 11, the fluid flow through atomizer 600 is described. Design considerations for atomizer 600 are presented in Section IV.C, in conjunction with FIG. 12. An example of a working nozzle is provided in Section IV.D with reference to FIG. 13. Finally, in Section IV.E, a system for fire-suppression that employs atomizer 600 is depicted in FIG. 14.

IV.A Structure of Atomizer 600

Figure 6A:
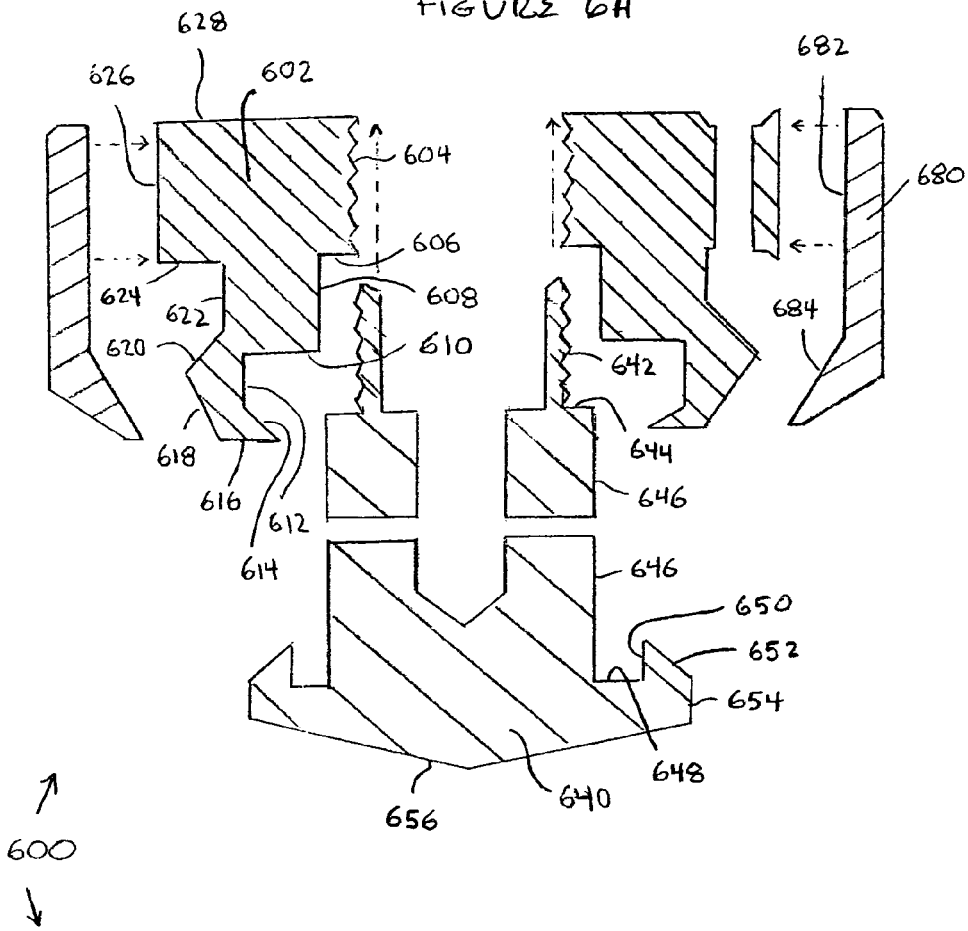
FIG. 6A depicts an exploded, cross-sectional view of atomizer 600, which is a specific implementation of atomizer 400 in accordance with the illustrative embodiment of the present invention.
Figure 6B:
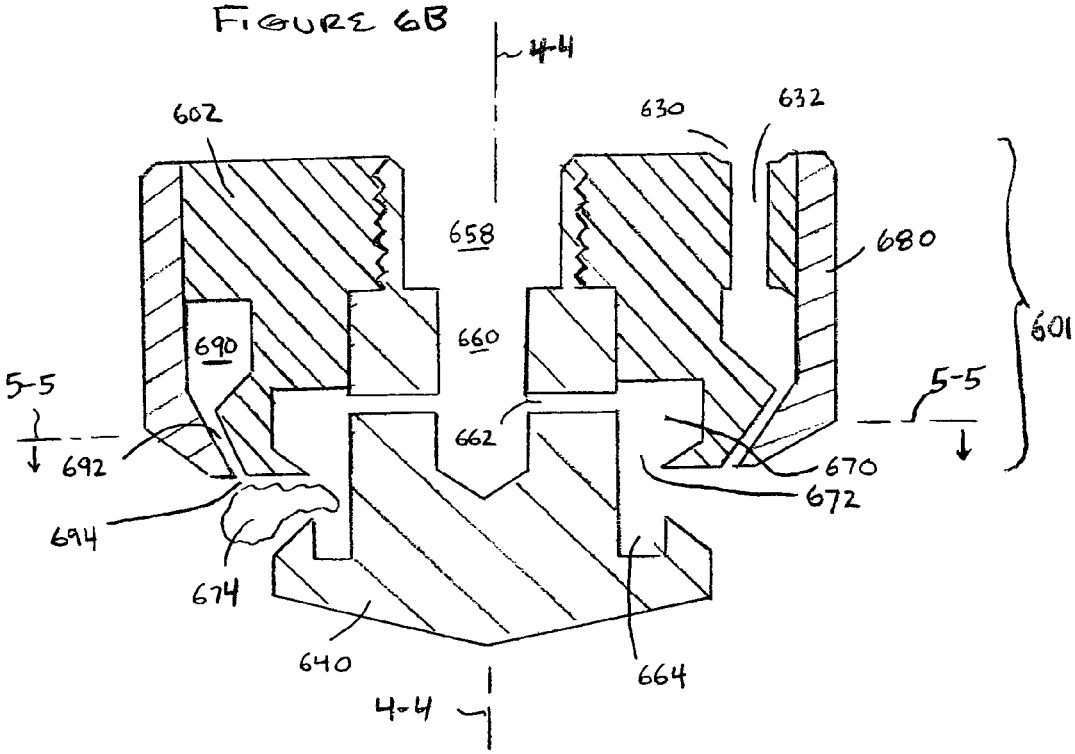
FIG. 6B depicts a cross-sectional view of atomizer 600.

FIGS. 6A and 6B depict a side cross-sectional view of atomizer 600 in accordance with the illustrative embodiment of the present invention. For increased clarity, FIG. 6A depicts atomizer 600 via an "exploded" view. After the structure of atomizer 600 is described, it will be related to features of illustrative atomizer 400.

Referring now to FIGS. 6A and 6B, atomizer 600 includes casing 602, central core 640, and cowling 680.

The profile of casing 602, when viewed in side cross section as depicted in FIGS. 6A and 6B, is varied or irregular and consists of various line straight line segments (e.g., segments 606, 608, etc.) that are disposed at different radial distances from central axis 4—4 of atomizer 600. It will be understood that this portion of the interior of atomizer 600 actually comprises circular cylindrical surfaces. As a consequence, many of the straight segments (e.g., segments 606, 608, etc.) that are depicted in the cross section are, in actuality, curved segments. Additionally, the profile includes several angled or tapered segments (e.g., segments 614, 618, etc.). It will be understood that this portion of the interior of atomizer 600 actually comprises circular conical surfaces. For simplicity, these various segments are shown as straight lines and will be referred to as "surfaces." The irregular profile and various surfaces of casing 602 serve several purposes.

One purpose of the irregular profile and various surfaces of casing 602 is to enable the casing and the central core to securely engage one another. Specifically, surface 604 of casing 602 receives surface 642 of central core 640. In the illustrative embodiment depicted in FIGS. 6A and 6B, these surfaces are threaded for secure, locking engagement. And surfaces 644 and 646 of central core 630 abut respective surfaces 606 and 608 of casing 602.

A second purpose of the irregular profile of casing 602 is to define, in conjunction with central core 640, various cavities and channels, including:

gas cavity 670; and gas nozzle 672.

The irregular profile of the outer surface of casing 602, in conjunction with cowling 680, defines the following cavities and channels:

liquid cavity 690;

liquid outlet channels 692; and liquid outlets 694.

More particularly, surfaces 610 and 612 of casing 602 and a portion of surface 646 of central core 630 define gas cavity 670. Angled surface 614 of casing 602 and a portion of surface 646 define gas nozzle 672.

Opposing and spaced from gas nozzle 672 is resonator 664, which is an annular channel that is defined by surfaces 646, 648 and 650 in the portion of central core 656 that extends from casing 602. In operation, resonator 664 brakes the gas that flows from gas nozzle 672. As described previously in conjunction with resonator 400, this braking creates intense oscillations of the gas (shock waves) that drive atomization of the liquid.

Cowling 680 engages the exterior of casing 602. In particular, an upper portion of surface 682 of the cowling abuts surface 626 of casing 602. The cowling and casing are joined by a press fit, or in other ways known to those skilled in the art.

Liquid inlet 630, which is disposed at surface 628 of casing 602, leads to liquid inlet channel 632. The liquid inlet channel leads, in turn, to liquid cavity 690. The liquid cavity is defined by surfaces 620, 622 and 624 of casing 602 and a lower portion of surface 682 and an upper portion of surface 684 of cowling 680.

Figure 7:
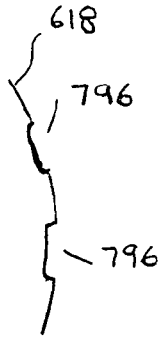
FIG. 7 depicts a cross-sectional view of central core 640 at line 5—5 in FIG. 6B in the direction shown.

Liquid cavity 690 feeds a plurality of liquid outlet channels 692, which lead to liquid outlets 694. As depicted in FIG. 7, which is a partial cross-sectional view of casing 602 through line 5-5 and viewed from the top in the direction of the arrows, each liquid outlet channel 692 is defined by groove 796, which is formed in the surface 618 of casing 602. When atomizer 600 is fully assembled, a second portion of surface 684 of cowling 680 covers grooves 796 to form liquid outlet channels 692. Neither the number nor size of liquid outlet channels 692 is particularly critical to atomizer operation. The liquid outlet channels must simply be capable of passing a desired amount of liquid (e.g., 2 kg/min, 6 kg/min, 10 kg/min, etc.) at the prevailing liquid pressure. In most embodiments, there will be between about 4 to 20 liquid outlet channels 692 each having a width of several millimeters (e.g., 2 mm to 6 mm, etc.) and a depth of less than a millimeter (e.g., 0.2 mm to 0.6 mm, etc.).

In some prior-art nozzles, such as the ones disclosed in U.S. Pat. Nos. 4,408,719 and 6,390,203, the water nozzle is configured as a "ring" or annular region that surrounds the gas nozzle. The ring configuration of the water nozzle is dependent upon relatively precise machining and adjustment for proper operation of the atomizer. For example, if the gap that defines the annular nozzle is not uniform around the full circumference of the nozzle, channeling might occur, wherein liquid flows preferentially in the region of the nozzle where the gap is largest. Using grooves 796 to form liquid outlet channels 692 substantially reduces the likelihood of such a problem occurring in atomizer 600.

Figure 8:
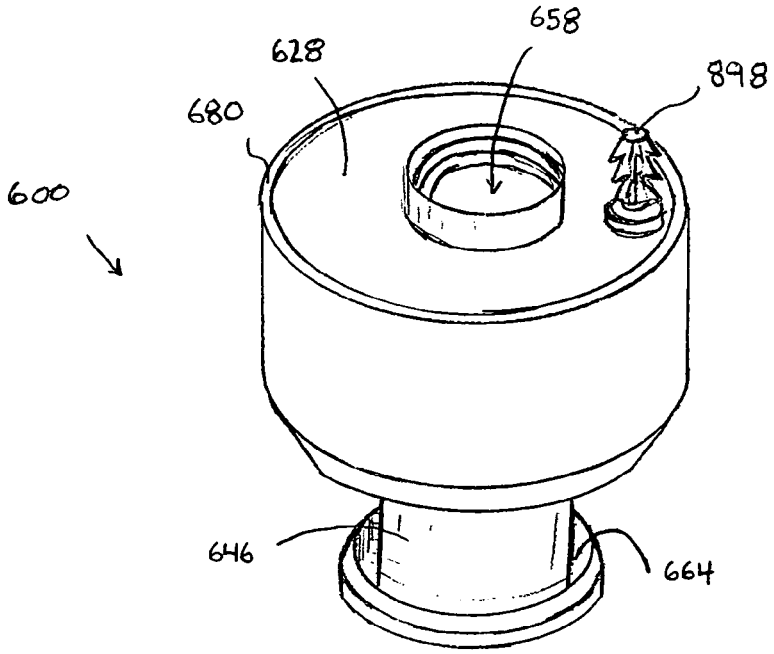
FIG. 8 depicts a perspective view of atomizer 600.

FIG. 8 depicts a perspective view of atomizer 600. Top surface 628 of casing 602, the exterior of cowling 680, and a portion of central core 640 are visible in FIG. 8. The visible portion of central core 640 includes surface 646 and resonator 664. Fitting 898 is engaged to liquid inlet 630. In some embodiments, fitting 898 is used to couple liquid inlet 630 to a hose (not depicted) through which liquid (e.g., water, etc.) is supplied to atomizer 600.

Figure 9:
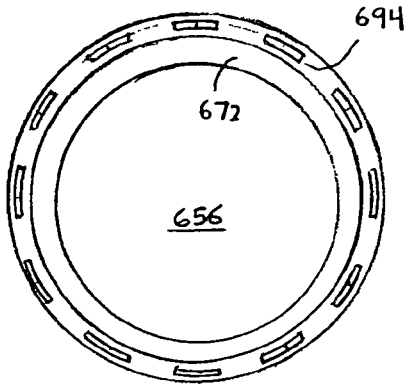
FIG. 9 depicts a bottom view of atomizer 600 showing a gas outlet nozzle and water outlet nozzles.

FIG. 9 depicts a bottom view of atomizer 600. In this view of atomizer 600, liquid outlets 694, annular gas nozzle 672, and bottom surface 656 of central core 630 are visible.

With reference to FIG. 10, atomizer 600 comprises three main parts: casing 602, central core 640, and cowling 680. The use of so few parts generally results in reduced manufacturing cost and improved reliability relative to atomizers that have a greater number of parts. Furthermore, having fewer parts reduces alignment issues such that the consistency of operation from atomizer to atomizer is very consistent (i.e., low coefficient of variation).

Table 1 below relates some of the structure of atomizer 600 to certain structural features of atomizer 400.

TABLE 1

Correspondence Between Atomizer 600 and Atomizer 400

| ATOMIZER 400 | ATOMIZER 600 |
|---|---|
| Body Portion 405 | Casing 602, cowling 680, and upper portion of central core 640 |
| Arrangement 404 for generating pulsations | Gas cavity 670, gas nozzle 672 |
| Arrangement 412 for conducting liquid | Liquid cavity 690; liquid outlet channels 692; and liquid outlets 694 |
| Liquid outlet 414 | Liquid outlets 694 |
| Arrangement 406 for Braking | Resonator 664 |

IV.B Fluid Flow Through Atomizer 600

Referring now to FIG. 11, which depicts the flow of gas and liquid through atomizer 600, and with continuing reference to FIG. 6B, gas flows to axially-disposed channel 658 and then passes to axially-disposed channel 660 in central core 640 of atomizer 600. Radially-disposed apertures 662 in central core 640 enable gas to pass from axially-disposed channel 660 into gas cavity 670. Gas flows from gas cavity 670 through gas nozzle 672, which tapers from a maximum width (nearest cavity 670) to a minimum width (as the gas exhausts toward resonator 664).

Liquid is supplied to atomizer 600 at inlet 630, which is located at a marginal portion of casing 602. Liquid flows from inlet 630, through liquid inlet channel 632 to annular liquid cavity 690. In the illustrative embodiment, in which liquid is provided via a single inlet 630, liquid cavity 690 provides for a uniformity of flow of the liquid about the circumference of casing 602.

Liquid exits liquid cavity 690 through liquid outlet channels 692. Liquid outlet channels 692 leads to liquid outlets 694. From the liquid outlets, the liquid enters atomization zone 674, which is located near the gap between resonator 664 and gas nozzle 672, but radially outward thereof to the region beneath liquid outlets 694. The intense oscillation of the gas causes the liquid entering this zone to atomize. This phenomenon is described in further detail below.

Atomizer 600 is designed for a specific liquid flow rate. Atomizers designed for 2 kilograms/minute, 6 kilograms/minute, and 10 kilograms/minute have been built and tested. The gas flow rate, in kilograms per minute, is typically in the range of about 0.7 to 1.5 times the liquid mass-flow rate. In other words, for a 2 kg/min atomizer, the gas flow will be in a range of about 1.4 to 3 kg per minute, for a 6 kg/min atomizer, the gas flow will be in a range of about 4.2 to 9 kg per minute, and for a 10 kg/min atomizer, the gas flow will be in a range of about 7 to 15 kg/min.

A most desirable ratio of the mass flow rate of gas to liquid will generally exist and is application-specific. For example, for fire suppression with water and nitrogen, the gas-to-liquid mass-flow ratio is advantageously about 1.0. But even within the context of fire suppression, this ratio can vary from installation to installation. As a consequence, the gas-to-liquid mass-flow rate is best determined by simple experimentation, using the range provided above as a starting point.

IV.C Design Considerations and Theory

In this Section, design considerations and theory is presented for atomizer 600. Some of the information appearing in this Section has been previously presented in conjunction with the description of method 200 and atomizer 400. It is to be understood that the theory and considerations presented in this Section are generally applicable to the illustrative embodiments (i.e., method 200 and atomizer 400) unless otherwise noted.

Figure 12:
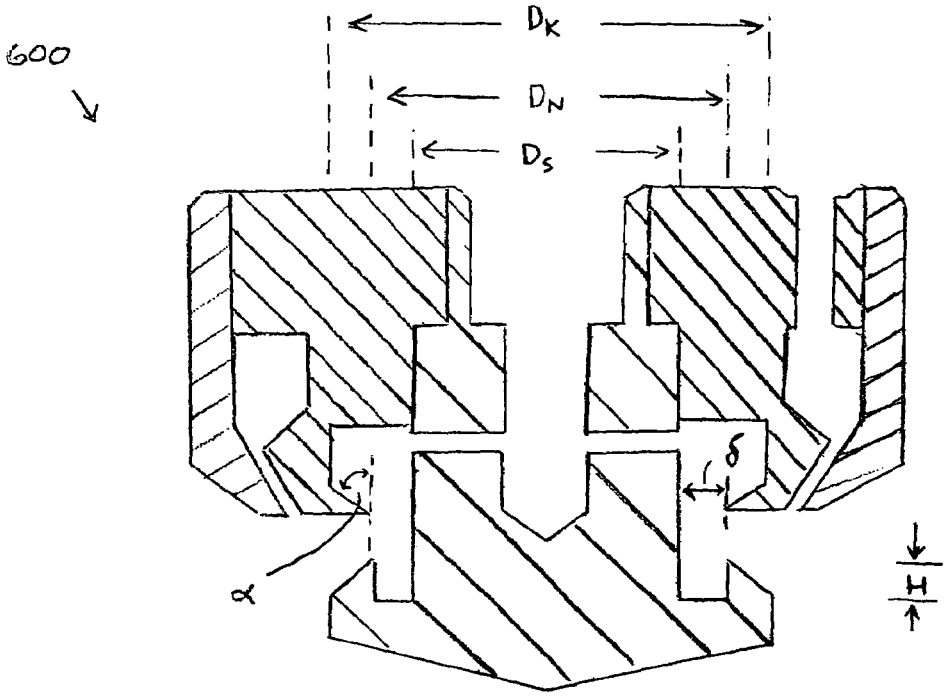
FIG. 12 depicts some important dimension, and parameters of atomizer 600.

Several dimensions and parameters are defined below and are depicted in FIG. 12 for use in the following description. In particular:

The conicity angle, $\alpha$, is the complement of the angle subtended between surfaces 614 and 616 of casing 602.

$D_K$ is the diameter of gas cavity 670.

$D_S$ is the diameter of central core 640.

$D_N$ is the diameter of gas nozzle 672.

$\delta$ is the width of the mouth of gas nozzle 672.

H is the height of resonator 664.

As long as the pressure of gas within gas cavity 670 exceeds a critical pressure (typically 21 psig), gas is discharged from gas nozzle 672 at sonic velocity (i.e., Mach 1), as is desirable.

Gas cavity 670 should have a compression factor, $\mu$, at gas nozzle 672 that within a range of about 5 to about 50, and is advantageously in the range of about 5 to about 30, wherein the compression factor is given by the relation:

$$\mu=(D_k^2-D_s^2)/(D_n^2-D_s^2) \quad [4]$$

The magnitude of the compression factor, μ, affects:
the ability to uniformly fill gas cavity 670; and
the gas flow through gas nozzle 672.

Regarding the latter effect, this pertains to the generation of transverse components of speed as well as an inflection point in the velocity profile.

Increasing the compression factor improves some aspects of atomizer performance. But increases in the compression factor will increase pressure drop across gas nozzle 672. This will require an increase in the gas inlet pressure. As gas pressure in atomizer exceeds about 52 psig, efficiency of the atomizer will drop to low levels. It is expected that at a compression factor of about 50, the efficiency of the atomizer (as previously defined) will be at about 10 percent. Furthermore, while there are many applications in which the increase in pressure is of no consequence, there might be applications where maintaining low gas-supply pressure is important (e.g., fire-suppression in aircraft, etc.).

As the gas discharges from gas nozzle 672, it expands, and its speed becomes supersonic. The gas is abruptly braked by resonator 664, which results in shock waves, which create relatively high sound-pressure levels in atomization zone 674.

It is known that there exists some threshold sound pressure that is required to begin dispersing liquid into droplets (i.e., atomization). This threshold depends upon a variety of factors, including the surface tension of the liquid being atomized, the shape of the initial "jet" of liquid issuing from liquid outlets 694, and the presence of a gas flow. The sound pressure level required for efficient atomization of water, for example, is in the range of 160 to 170 dB, which corresponds to a sound intensity in the atomization zone in the range of about 1–10 W/cm$^2$. Thus, in accordance with the illustrative embodiment, the sound pressure levels in atomization region 674 are at least 160 dB when the liquid being atomized is water.

For a near-wall ring jet, such as occurs in the configuration of atomizer 600, the unsteady modes that are formed as a result of the deceleration of the gas caused by an empty resonator are realized at Strouhal numbers, Sh, that are close to the quarter-wavelength resonance. That is:

$$Sh=\Delta/\lambda=0.21 \text{ to } 0.23 \quad [5]$$

where: Δ is cell length of the supersonic jet; and
λ is wavelength and λ=c/f (c is the speed of sound in the gas
and f is the generation frequency).

The cell length, Δ, is proportional to the width of the nozzle gap δ and also depends upon both the pressure, P of the supplied gas (advantageously within a range of about 25 to 55 psig) and the transverse curvature of the out-flowing jet of gas. For a near-wall ring jet, cell length is given by the expression:

$$\Delta=(1.1D_n-0.08(D_s)^2-0.15D_s)\times(P-0.9)^{1/2} \quad [6]$$

The (jet) curvature parameter is determined by the ratio between the diameter $D_s$ of central core 630 and the diameter $D_n$ of gas nozzle 654:

$$R=D_s/D_n \quad [7]$$

The curvature parameter determines the compressibility of the ring jet in the radial direction. That is, it is an indication of how much the jet deviates from a planar jet. In some embodiments, such as those in which atomizer 600 is used in conjunction with a fire-suppression system, the curvature parameter, R, should be within the range of about 0.8 to about 0.9. This is a relatively high value for the curvature parameter. Atomizers for use in applications that require a very fine mist at a very small discharge rate (e.g., delivery of medications to new-born babies, etc.) will typically have a lower value for the curvature parameter, typically about 0.2.

For all ranges of the curvature parameter, R, the Strouhal numbers are obtained for:

$$\delta=(0.03\leftrightarrows0.055)\lambda. \quad [8]$$

The relationship between δ and λ is quite complex since wavelength (or frequency) is a function of gas pressure, resonator parameters, gas jet curvature and other parameters. This is accounted for by a constant that is multiplied by λ and which falls in the range of 0.03 to 0.055. This range for the constant is used for all values of the curvature parameter, R.

The atomization process depends not only on the sound pressure level, but also on the frequency of the sound. In particular, the size of the resulting liquid droplets decreases with increasing frequency of acoustic waves and with increasing sound pressure. A simplified expression for predicting the diameter, d, of an equivalent spherical small drop of atomized liquid at about sound level of about 169 dB is given by:

$$d=2\times\{(6\pi s)/[\rho_L(2f)^2]\}^{1/3} \quad [9]$$

where: s is liquid surface tension;
$\rho_L$ is liquid density; and
is acoustic frequency.

While the size of droplets that are produced from an actual atomizer will tend to vary somewhat from the values predicted from expression [9], this expression provides a good starting point for design purposes. Once an atomizer design is established, droplet size is readily varied, as desired, by simply changing the liquid rate. For example, for a given shock wave intensity, reducing the liquid rate will reduce droplet diameter. Conversely, increasing the liquid rate will increase droplet diameter. It has been found that to obtain water droplets in the size range of 50 to 90 microns, which is a useful range for fire suppression among other applications, frequency must be within the range of about 16 to 20 kHz.

The frequency of acoustic oscillations is a function of the height H of resonator 664 and the width δ at the mouth of gas nozzle 672. The required droplet dimensions (e.g., 50–90 microns) can be achieved by using a resonator having height H that is determined by the relation:

$$H=(3\leftrightarrows5)\delta \quad [10]$$

since the necessary sound pressure levels of 160–170 dB can be obtained only for these values of H. It is believed that, among other influences, the height of the resonator affects the structure of the near-wall gas ring jet, which determines the frequency and intensity of shock waves. This relationship is quite complex, and, in expression [10] above, is accounted for by an empirically-determined constant, which falls within the range of 3 to 5 inclusive.

It is known that as the sound pressure level in the atomization region increases, the efficiency of atomization increases. It is also known that as the instability of the gas jet increases, relatively higher sound-pressure levels are generated in the atomization region. As previously described, to create the requisite instability requires the presence of sufficient transverse components of speed and a velocity profile that contains an inflection point. In atomizer 600, this instability is promoted by a combination of at least some of the following factors: appropriate gas pressure (between about 21–52 psig at gas cavity 670), judicious design of gas cavity 670, as well as appropriate selection of values for the compression factor μ, (between about 5 to about 50) and the conicity angle a (between about 50 to about 80 degrees).

In this context, consider the structure of gas cavity 670. The gas flowing into gas cavity 670 is moving in a direction that is substantially different from the direction of the bulk gas flow leaving gas cavity 670. As a consequence, and in conjunction with the pressure factor and conicity angle, the trajectories of the gas particles change sharply. This generates transverse components of speed as the gas leaves gas nozzle 672.

Tests were conducted to compare the performance of atomizer 100 with atomizer 600. The results of the tests showed that when the conicity angle, compression factor, and gas pressure were within the specified range, the atomization efficiency of atomizer 600 was as high as about 26 percent, as compared to an efficiency of about 5 percent for atomizer 100. The intensity of the shock waves in atomization region 694 of atomizer 600 was 4 dB higher than that achieved in atomizer 100.

IV.D Dimensions of an Embodiment of Atomizer 600

Atomizers consistent with the illustrative embodiment have been built and test. The dimensions of one such atomizer, as referenced to FIG. 13, are given below. This atomizer was operated at the conditions given below with an efficiency exceeding 25 percent. It is noted that the operating range of this atomizer is, in fact, broader than the tested range of flow rate and pressure.

| | | |
|---|---|---|
| Liquid:Water | Flow rate: 2 kg of water/min | Pressure: 5 psig |
| Gas:Nitrogen | Flow rate: 1.8 to 2.3 kg/min | Pressure: 35–49 psig |
| $D_{CL}$: 70.0 mm | $D_{GI}$: 12.7 mm | |
| $D_{CA}$: 60.0 mm | $D_{AG}$: 10.0 mm | |
| $D_{WC}$: 28.0 mm | $D_{RG}$: 3.0 mm | (12 equally-spaced apertures) |
| $D_K$: 22.0 mm | $D_{LI}$: 10.0 mm | |
| $D_R$: 16.7 mm | $D_{LO}$: Depth: 0.3 mm | (6 equally-spaced grooves) |
| $D_N$: 15.0 mm | Width: 4.0 mm | |
| $D_S$: 13.6 mm | | |

IV.E System for Fire-Suppression Using Atomizer 600

As previously indicated, there are many uses for the present atomizer. One use is in conjunction with a system for fire suppression. An illustrative fire-suppression system 1400 is depicted in FIG. 14.

Fire-suppression system 1400 includes two atomizers for protecting area 1416, such as atomizers 600. Each atomizer 600 is supplied with gas from gas source 1402 via piping 1406. Similarly, the atomizers are supplied with liquid from liquid source 1408 via piping 1412.

Detector 1414 is capable of detecting an indication of fire (e.g., temperature, smoke, etc.) When fire is detected, detector 1414 sends signals to control valves 1404 and 1410 to begin respective flows of gas and liquid to atomizers 600. Those skilled in the art will be able to engineer fire-suppression systems to meet any of a variety of needs. See, for example, U.S. Pat. No. 6,390,203.

In this Specification, numerous specific details are disclosed in order to provide a thorough description and understanding of the illustrative embodiments of the present invention. Those skilled in the art will recognize, however, that the invention can be practiced without one or more of the specific details, or with other variations of the illustrative methods, materials, components, etc. In some instances, well-known structures, materials, or operations are not shown or described in detail to avoid obscuring aspects of the illustrative embodiments.

It is understood that the various embodiments shown in the Figures are illustrative representations, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily in all embodiments. Consequently, appearances of the phrases "in one embodiment," "in an embodiment," or "in some embodiments" in various places throughout the Specification are not necessarily referring to the same embodiment. Furthermore, the particular features, structures, materials, or characteristics can be combined in any suitable manner in one or more embodiments.

Furthermore, it will be understood that the above-described embodiments are merely illustrative of the present invention and that many variations of the above-described embodiments can be devised by those skilled in the art without departing from the scope of the invention. For example, in conjunction with the description of the illustrative embodiments—method 200 and atomizer 400—and with a specific implementation thereof—atomizer 600—it is expected that those skilled in the art will be able to develop other specific variations that are consistent therewith. It is therefore intended that such variations be included within the scope of the following claims and their equivalents.

We claim:

1. An apparatus comprising an atomizer, wherein said atomizer comprises;

a body portion, wherein said body portion comprises:

(a) a gas aperture;

(b) an annular gas cavity, wherein said gas cavity receives a flow of gas from said gas aperture; and (c) an annular gas nozzle, wherein said gas nozzle receives said flow of gas from said gas cavity, wherein:

a bulk of said flow of gas flows in a radial direction through said gas aperture; and a bulk of said flow of gas flows in an axial direction through said gas nozzle; and a resonator, wherein said resonator is spaced apart from said gas nozzle and receives said flow of gas therefrom.

2. The apparatus of claim 1 wherein said body portion comprises:

a liquid inlet, wherein said liquid inlet is disposed at a marginal region of said body portion;

an annular liquid cavity, wherein said liquid cavity receives a flow of liquid from said liquid inlet; and an liquid outlet, wherein said liquid outlet receives said flow of liquid from said annular liquid cavity.

3. The apparatus of claim 2 wherein said liquid outlet delivers said flow of liquid to an atomization region that is disposed proximal to said gas nozzle.

4. The apparatus of claim 2 wherein said gas comprises a mixture that is non-toxic.

5. The apparatus of claim 2 wherein said gas comprises nitrogen and carbon dioxide.

6. The apparatus of claim 1, wherein said atomizer consists essentially of three parts, wherein said three parts are:

a casing, wherein said casing has an axially-disposed opening for receiving said flow of gas;

a central core, wherein a portion of said central core is received by said opening in said casing, and wherein said gas cavity and said gas nozzle are defined in a space between said casing and said central core; and a cowling, a portion of said cowling abuts a portion of an outer surface of said casing, wherein said body portion comprises said casing, said cowling, and an upper portion of said central core.

7. The apparatus of claim 6 wherein an annular liquid cavity and a liquid outlet channel are defined by a surface of said cowling and a groove in said casing.

8. The apparatus of claim 6 wherein said gas aperture defines a hole through said central care, thereby fluidically coupling said axially-disposed opening in said casing with said gas cavity.

9. The apparatus of claim 6 wherein said gas aperture is substantially perpendicular to said axially-disposed opening in said casing.

10. The apparatus of claim 6, wherein said resonator is defined by an annular channel in a lower portion of said central core, wherein said annular channel is spaced apart from and disposed in opposition to said gas nozzle.

11. The apparatus of claim 1 wherein said resonator is dimensioned and arranged to provide a frequency of oscillation that is in a range of about 16 kHz to about 20 kHz.

12. The apparatus of claim 1 wherein said gas nozzle has a conicity angle that is within a range of about 50 to about 80 degrees.

13. The apparatus of claim 1 wherein a compression factor across said gas nozzle is in a range of about 5 to about 50.

14. The apparatus of claim 1 wherein a pressure of said gas at an inlet to said atomizer is in a range of about 25 to about 55 psig.

15. The apparatus of claim 1 wherein a pressure of said gas at said gas nozzle is in a range of about 21 psig to about 52 psig.

16. The apparatus of claim 1 wherein said apparatus is a system for fire suppression, and wherein said liquid is water and said gas comprises nitrogen, and further wherein said system comprises:

a first conduit for coupling said atomizer to a supply of said liquid;

a second conduit for coupling said atomizer to a supply of said gas; and a detection device for detecting a condition indicative of fire.

17. An apparatus comprising an atomizer, wherein said atomizer comprises:

a gas inlet for receiving a flow of gas;

a plurality of gas apertures, wherein said gas aperture are in fluidic communication with said gas inlet;

a gas cavity, wherein said gas cavity is in fluidic communication with said gas apertures; and a gas nozzle, wherein said gas nozzle is in fluidic communication with said gas cavity, and wherein a compression factor across said gas nozzle is in a range of about 5 to about 50, and further wherein a conicity angle of said gas nozzle is in a range of about 50 to about 80 degrees.

18. The apparatus of claim 17, further comprising a liquid inlet, wherein said liquid inlet receives a flow of liquid.

19. The apparatus of claim 18, further comprising a liquid outlet, wherein said gas and said liquid do not come into contact with each until said liquid passes through said liquid outlet and said gas passes through said gas nozzle.

20. The apparatus of claim 19 wherein a pressure of said gas is sufficient so that when said flow of gas exits said gas nozzle, a velocity of said flow of gas is supersonic.

21. The apparatus of claim 20 further comprising a surface for braking said supersonic flow of gas.

22. The apparatus of claim 21 wherein said surface for braking is configured to function as a resonator, wherein said surface for braking is spaced apart and disposed in opposition to said gas nozzle, and wherein atomization of said liquid occurs in a region between said gas nozzle and said resonator.

23. The apparatus of claim 18, further comprising a liquid outlet, wherein said gas and said liquid do not come into contact with each other until said flow of gas is accelerated to supersonic velocity.

24. The apparatus of claim 18, wherein said liquid outlet comprises a plurality of grooves, not a continuous annular region.

25. The apparatus of claim 18 wherein said gas is non-toxic and comprises a mixture of nitrogen and carbon dioxide.

26. The apparatus of claim 17 wherein said gas nozzle is defined by narrowing a width of said gas cavity.

27. The apparatus of claim 17 wherein said gas inlet, said gas apertures, and said gas nozzle are physically configured so that:

said flow of gas through said gas nozzle is substantially parallel to said flow of gas into said gas inlet, and said flow of gas through said gas apertures is substantially orthogonal to said flow of gas into said gas inlet and through said gas nozzle.

28. The apparatus of claim 17 wherein said gas apertures are configured to deliver said gas to an upper portion of said gas cavity.

29. The apparatus of claim 17 wherein said gas flows in a first direction as it enters said gas cavity and said gas flows in a second direction as it leaves said gas cavity, wherein said first direction is substantially different from said second direction.

30. The apparatus of claim 29 wherein said first direction is substantially perpendicular to said second direction.

31. An apparatus comprising an atomizer, wherein said atomizer comprises a body portion, wherein said body portion comprises:

a liquid inlet for receiving a flow of liquid;

a gas inlet for receiving a flow of gas;

means for introducing instability in said flow of said gas;

a gas nozzle through which said flow of gas exits said body portion; and a resonator, wherein said resonator is spaced apart from said body portion and is disposed in opposition to said gas nozzle, and wherein:

(1) a compression factor across said nozzle is in a range of about 5 to about 50; and (2) a conicity angle of said nozzle is in a range of about 50 to about 80 degrees.

32. The apparatus of claim 31 wherein said compression factor across said gas nozzle is within a range of about 5 to about 30.

33. The apparatus of claim 31 wherein said flow of liquid and said flow of gas do not contact each other until said flows exit said body portion of said atomizer.

34. The apparatus of claim 31, wherein said atomizer comprises:

a casing, wherein said casing has an axially-disposed opening;

a central core, wherein a portion of said central core is received by said opening in said casing, and wherein a gas cavity and said gas nozzle are defined in a space between said casing and said central core; and a cowling, a portion of said cowling abuts a portion of an outer surface of said casing, wherein:

(1) said body portion comprises said casing, said cowling, and an upper portion of said central core; and (2) said means for introducing instability comprises said gas cavity.

35. The apparatus of claim 31, wherein a jet curvature parameter is within a range of about 0.8 to about 0.9, wherein said jet curvature parameter is obtained by dividing an outer diameter of said central core by a diameter of said gas nozzle.

* * * * *